US008485254B2

(12) United States Patent
Huber et al.

(10) Patent No.: US 8,485,254 B2
(45) Date of Patent: Jul. 16, 2013

(54) METHOD AND APPARATUS FOR IN SITU EXTRACTION OF BITUMEN OR VERY HEAVY OIL

(75) Inventors: Norbert Huber, Erlangen (DE); Hans-Peter Krämer, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 461 days.

(21) Appl. No.: 12/674,699

(22) PCT Filed: Aug. 19, 2008

(86) PCT No.: PCT/EP2008/060851
§ 371 (c)(1), (2), (4) Date: Feb. 23, 2010

(87) PCT Pub. No.: WO2009/027273
PCT Pub. Date: Mar. 5, 2009

(65) Prior Publication Data
US 2011/0108273 A1 May 12, 2011

(30) Foreign Application Priority Data
Aug. 27, 2007 (DE) ..... 10 2007 040 607

(51) Int. Cl.
*E21B 43/24* (2006.01)
*E21B 36/00* (2006.01)

(52) U.S. Cl.
USPC ..... 166/272.3; 166/57; 166/272.1

(58) Field of Classification Search
USPC ..... 166/248, 268, 275, 272.1, 272.3, 166/272.7, 57
See application file for complete search history.

(56) References Cited

U.S. PATENT DOCUMENTS

| | | | | | |
|---|---|---|---|---|---|
| 2,801,090 | A | | 7/1957 | Hoyer et al. | |
| 3,605,888 | A | | 9/1971 | Crowson et al. | |
| 3,972,372 | A | | 8/1976 | Fisher et al. | |
| 4,008,761 | A | | 2/1977 | Fisher et al. | |
| 4,008,762 | A | * | 2/1977 | Fisher et al. | 166/248 |
| 4,084,637 | A | * | 4/1978 | Todd | 166/245 |
| 4,084,638 | A | * | 4/1978 | Whiting | 166/248 |
| 4,228,853 | A | * | 10/1980 | Harvey et al. | 166/248 |
| RE30,738 | E | * | 9/1981 | Bridges et al. | 166/248 |
| 4,303,128 | A | | 12/1981 | Marr, Jr. | |
| 4,359,091 | A | | 11/1982 | Fisher et al. | |
| 4,499,948 | A | * | 2/1985 | Perkins | 166/248 |
| 4,545,435 | A | * | 10/1985 | Bridges et al. | 166/248 |
| 4,620,592 | A | | 11/1986 | Perkins | |

(Continued)

FOREIGN PATENT DOCUMENTS

| | | | |
|---|---|---|---|
| RU | 2005138255 | A | 6/2007 |
| RU | 2295030 | C1 | 10/2007 |
| WO | WO 03/054351 | A1 | 7/2003 |

*Primary Examiner* — Giovanna Wright
*Assistant Examiner* — Michael Wills, III

(57) ABSTRACT

A method for the in situ extraction of bitumen or very heavy oil from oil sand deposits close to the surface, where thermal energy is introduced into the deposit to reduce the viscosity of the bitumen or very heavy oil is provided. Condensed water is used that is introduced into the deposit via an injection pipe and is horizontally conducted inside the pipe within the deposit such that the water can evaporate in situ and the heat can be applied to the deposit. An apparatus including an injection pipe, an extraction pipe, a converter and electrical conductors are also provided.

17 Claims, 3 Drawing Sheets

U.S. PATENT DOCUMENTS

| | | | | |
|---|---|---|---|---|
| 4,679,626 | A * | 7/1987 | Perkins | 166/248 |
| 6,189,611 | B1 * | 2/2001 | Kasevich | 166/248 |
| 6,257,334 | B1 | 7/2001 | Cyr et al. | |
| 6,631,761 | B2 * | 10/2003 | Yuan et al. | 166/248 |
| 7,090,014 | B2 * | 8/2006 | Good et al. | 166/272.3 |
| 7,128,153 | B2 * | 10/2006 | Vinegar et al. | 166/285 |
| 2005/0199386 | A1 | 9/2005 | Kinzer | |
| 2006/0102625 | A1 * | 5/2006 | Kinzer | 219/772 |
| 2006/0151166 | A1 | 7/2006 | Montgomery et al. | |
| 2006/0175053 | A1 | 8/2006 | Marchal | |
| 2006/0213657 | A1 * | 9/2006 | Berchenko et al. | 166/245 |
| 2007/0023186 | A1 * | 2/2007 | Kaminsky et al. | 166/266 |
| 2007/0295499 | A1 * | 12/2007 | Arthur et al. | 166/245 |
| 2008/0236817 | A1 * | 10/2008 | Tillman | 166/251.1 |
| 2010/0319909 | A1 * | 12/2010 | Symington et al. | 166/245 |

* cited by examiner

METHOD AND APPARATUS FOR IN SITU EXTRACTION OF BITUMEN OR VERY HEAVY OIL

CROSS REFERENCE TO RELATED APPLICATIONS

This application is the US National Stage of International Application No. PCT/EP2008/060851, filed Aug. 19, 2008 and claims the benefit thereof. The International Application claims the benefits of German application No. 10 2007 040 607.1 DE filed Aug. 27, 2007. All of the applications are incorporated by reference herein in their entirety.

FIELD OF INVENTION

The invention relates to a method for the in situ extraction of bitumen or very heavy oil from oil sand deposits close to the surface, thermal energy being introduced into the deposit to reduce the viscosity of the bitumen or very heavy oil, with at least one extraction pipe being used to extract the liquefied bitumen or very heavy oil and at least one pipe being used to introduce thermal energy, the two pipes being routed parallel to one another. The invention also relates to an associated apparatus for implementing the method, with at least one injection pipe for introducing energy into the deposit and at least one extraction pipe for extracting oil from the deposit, both pipes running horizontally in the deposit.

BACKGROUND OF INVENTION

During the in situ breaking down of bitumen from oil sand by means of steam and horizontal bore holes by means of the SAGD (Steam Assisted Gravity Drainage) method, large quantities of water vapor are required to heat the bitumen. Steam at a temperature of 250° C. with a quality of 0.95, i.e. almost superheated, is typically used. Although this steam has a high energy content, very large quantities of water accumulate and are extracted with the oil back to the surface and have to be processed there with significant outlay.

When using steam, the use of horizontal injection pipes longer than 1000 m is no longer practical due to the resulting pressure loss, which is known to be a function of the pipe length.

A SAGD method for extracting very heavy oil is known from U.S. Pat. No. 6,257,334 B1, in which, in addition to a so-called well pair consisting of pipes one on top of the other, further elements are also present, which are intended to improve the heating of the region. Also a facility for the electrical heating of certain regions is known from WO 03/054351 A1, with which a field is generated between two electrodes, heating the region in between them.

A method for the heavy oil deposit is also known from US 2006/015166 A1, in which a tool with electrodes is provided for the three-phase resistive heating of the deposit to reduce the viscosity of the heavy oil.

SUMMARY OF INVENTION

On this basis the object of the invention is to propose a method which does not use steam with its pressure loss and to create an associated apparatus.

The object in respect of the method is achieved by the measures of the claims and in respect of the apparatus by the features of the claims. Developments of the method and the associated apparatus are set out in the respectively dependent claims.

The subject matter of the invention is a method, wherein water is injected into the reservoir instead of steam and is only evaporated in the reservoir by means of electrical heating. Electrical, i.e. resistive, heating and/or electromagnetic, i.e. inductive, heating can be used for this purpose.

The inventive feature of inductive heating in particular means that electromagnetic dissipation occurs where electrical conductivity is high. Resistive heating is also suitable. The heating rate can advantageously be regulated by measuring the pressure and/or temperature in particular in the environment of the well pair or at other points. It is thus possible to ensure that certain pressure and temperature threshold values are not exceeded in the process.

With the invention therefore water is evaporated in situ by electrical heating.

One particular advantage of the invention is that it avoids the need for expensive water processing installations, as are used with the known SAGD method to eliminate oil residues from the water, for desalination and evaporation purposes. Also expensive consumables for water processing—such as filters, ion exchangers, etc.—are superfluous.

The low pressure loss with water compared with water vapor means that the in situ breaking down of bitumen can be carried out with much longer pipes than before (>1000 m). The energy costs for heating and evaporating the water can of course not be avoided and are instead incurred in the power plant. The fact that electric current can be transmitted over quite long distances means that power plants of large unit size can be used. The higher energy costs of electric current compared with steam (factor 2) can in some instances be offset by the above-mentioned savings.

Instead of converting the process totally from steam to water injection it is also possible in the context of the invention to switch to a lower steam quality or smaller steam quantity or preheated water, simply providing the missing energy electrically. This reduces the capital costs of the boiler.

A further advantage of the inventive method finally is that salts can be added to the water to increase conductivity, ensuring efficient heating.

BRIEF DESCRIPTION OF THE DRAWINGS

Further details and advantages of the invention will emerge from the description of figures of exemplary embodiments which follows based on the drawing in conjunction with the subclaims, in which drawing:

DETAILED DESCRIPTION OF INVENTION

Figure 1:
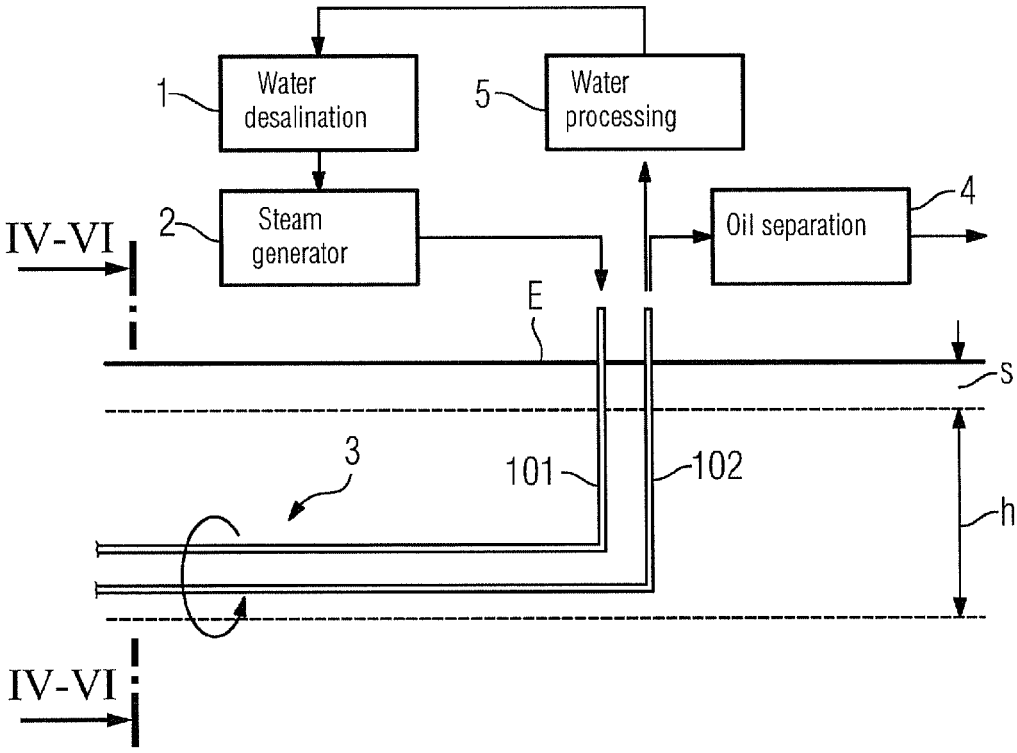
FIG 1 (Prior art)
FIG. 1 shows an outline of a method for introducing steam into an oil sand reservoir according to the prior art.

In FIG. 1 a thick line E shows the ground surface, below which an oil sand deposit is located. Generally a superstructure of rock or material is present below the ground surface, followed by a seam in the form of an oil sand reservoir at a predetermined depth. The reservoir has a height or thickness h, a length l and the predetermined width w. An elementary cell is thus defined, which can be repeated a number of times in respect of the width w. This region as part of the deposit therefore contains the bitumen or very heavy oil and is referred to below in short as the reservoir. With the known SAGD method an injection pipe 101 for steam and an extraction pipe 102, also referred to as a production pipe, are present and are routed horizontally on the bottom of the reservoir.

FIG. 1 shows an outline of a method according to the prior art. Shown as 1 is a water desalination unit, downstream of which a steam generator is connected. The injection pipe 101 is used to route steam initially vertically through the top surface of the oil sand deposit and from a certain depth, i.e. on reaching the reservoir, horizontally. The steam heats the area around the injection pipe 101 and reduces the viscosity of the bitumen or very heavy oil present in the oil sand. In the extraction pipe 102, which runs parallel to the injection pipe 101, the oil is recovered and fed back by way of the perpendicular region through the covering rock. Oil is then separated from the raw bitumen in a method-related installation 4 and further processing, e.g. flotation or the like, takes place. The water present is fed to a unit 5 for water processing and then fed back into the water desalination unit 1.

With the prior art therefore a circuit is largely present in the process sequence with the cited units.

Figure 2:
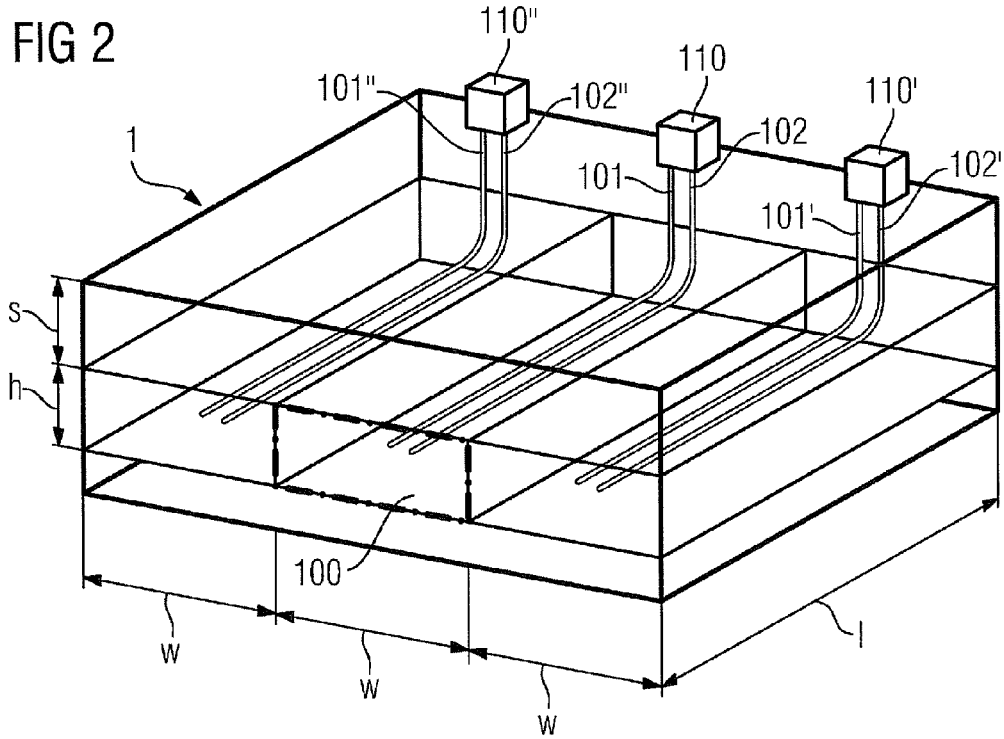
FIG. 2 shows a three-dimensional diagram of elementary units of the reservoir as an oil sand deposit.

FIG. 2 shows an oil sand deposit, having a longitudinal extension 1 and a height h. A width w is defined, which is used to define an elementary unit 100 as a reservoir for oil sand. In the prior art the injection pipe 101 and the extraction pipe 102 are routed in a parallel manner on top of one another in a horizontal direction in the unit.

Figure 3:
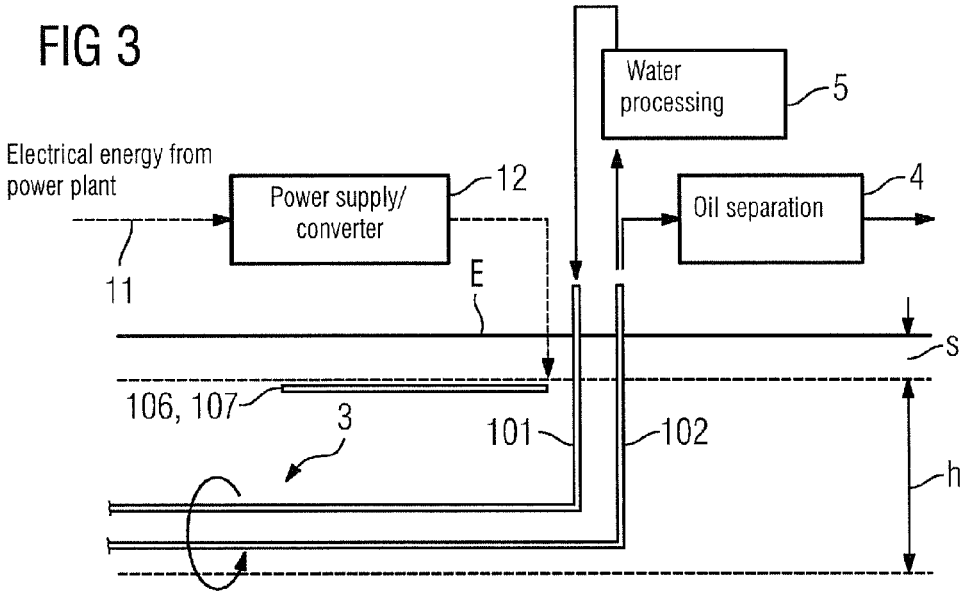
FIG. 3 shows the new method outline according to the inventive procedure and FIGS. 4 to 6 respectively show a section through a reservoir with different arrangements of injection bores or electrodes.

FIG. 3 shows the conditions in FIG. 1 with an inventive procedure or apparatus. Below the ground surface the initially vertically running injection and extraction pipes 101, 102 are again present, both running horizontally when they reach the reservoir. The injection pipe 101 and extraction pipe 102 are also configured as electrodes by means of a conductive coating and can thus serve as conductors for an electrical/electromagnetic heating unit to generate heat.

With the associated apparatus there is no longer a need for a steam generation installation and the water desalination installation connected upstream of it in FIG. 1. Instead there is a connection to an external—in some instances spatially very remote—power plant for providing electrical power and a unit 12 for the electrical power supply. Separate generators can also be present in some instances. The unit 4 for separating oil and the unit 5 for water processing can be of simpler structure here than in the prior art according to FIG. 1.

Simplified method implementation results with the new installation. The electrical energy is advantageously taken from a power plant and a converter is used in the unit 12 to provide the electrical power in suitable form, in particular as high-frequency current. The high-frequency current is passed to current conductors in the reservoir, for example the electrode 106 or 107, and serves there to generate heat. Inductive heating of the reservoir in particular is realized here. Resistive heating can also take place in some instances. A first end of one or more of the electrodes 106, 107 is connected electrically to a second end of the injection pipe 101 for inductive heating purposes The advantage of such a procedure is that only water has to be routed in the injection pipe 101. The water is evaporated in situ, i.e. in the horizontally running region around the injection pipe 101, by means of the electromagnetic effect, with the steam being produced in the horizontal region around the pipe 101. The energy of the steam thus produced is emitted to the reservoir, so that an oil sand/water mixture builds up in the extraction pipe 102. This is extracted to the ground surface by way of the extraction pipe 102—in some instances with an additional pump—with an oil separation installation again being provided. The remaining water is processed in the water processing unit and then fed back into the circuit.

The procedure shown in FIG. 3 has significant advantages compared with water vapor conveyance. Particularly if it is assumed that operation with long lengths 1 takes place in the deposit with the described installation, significant problems would also arise in remote regions with the steam method with regard to providing steam. In situ steam generation allows this problem to be resolved in a surprisingly simple manner.

Figure 4:
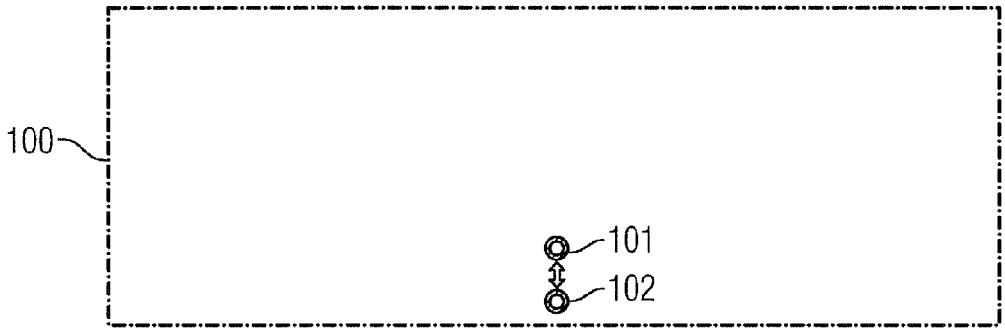
Figure 5:
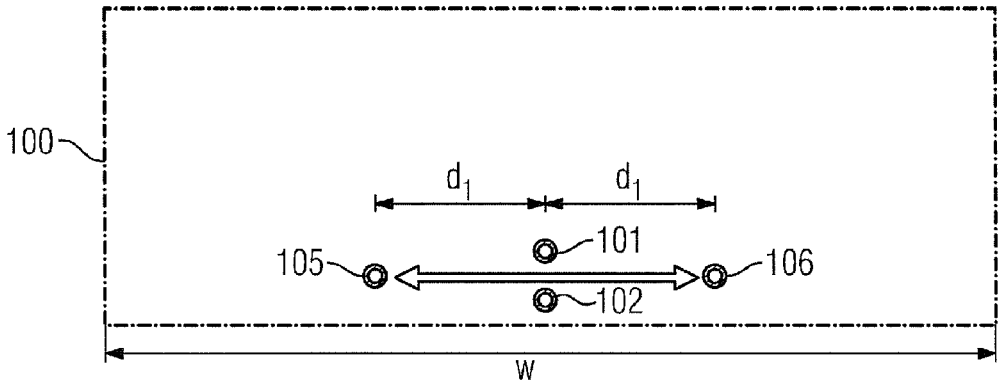
Figure 6:
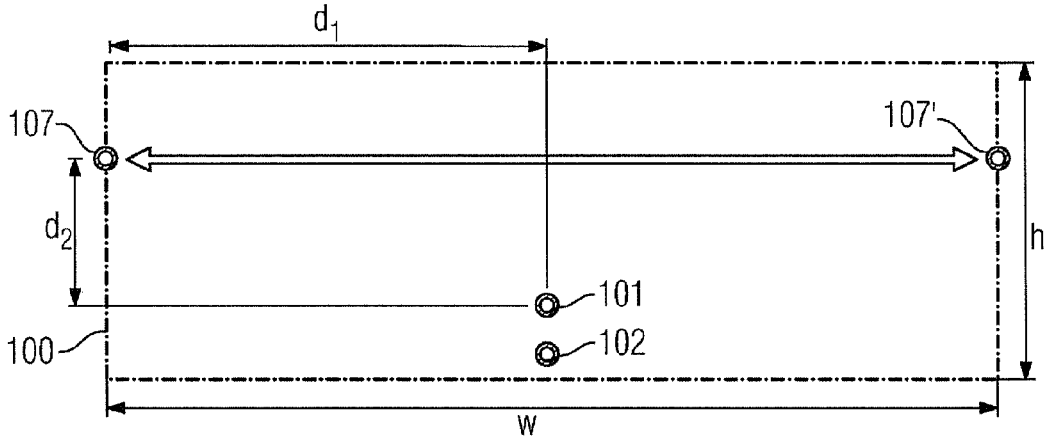

The further FIGS. 4 to 6 show various geometric possibilities for realizing the latter principle, the section IV-IV from the figure and/or the view from the front in FIG. 2 respectively being shown. FIG. 3 for example shows an injection pipe 101 and a production pipe 102, which are disposed a small distance from one another as far as possible on the bottom of the reservoir. The reservoir here is bounded by the width w and the height h. The length l is not shown in the sectional diagram according to FIGS. 3 to 5.

With the described arrangement according to FIG. 4 the injection pipe 101 and the production pipe 102 are themselves configured as electrodes. Heating here takes place resistively or inductively. In the described section of the oil reservoir 100 the arrangement shown is repeated a number of times periodically on both sides. Compared with the prior art the known horizontal pipe pair (so-called well pair) is changed in that it can also be used as electrodes.

In FIG. 5—based on the diagram according to FIG. 3—a well pair consisting of an injection pipe 101 and extraction pipe 102 is present. Two electrodes 105 and 106 are also disposed in proximity to the well pair. It is expedient to align these two electrodes at a distance $d_1$ from the line of the well pair on both sides and to select the height between the injection pipe 101 and the extraction pipe 102.

Configuring the horizontal pipes 105 and 106 as electrodes allows inductive energization by electrical connection at the ends of the additional electrode and the injection pipe. The reservoir width w here is for example 100m, the distance from one well pair to the next well pair is typically also around 100 m, with broad limits being set and a range between 50 and 200 m appearing suitable. The horizontal distance of the pipes 105 and 106 from the plane of the well pair is between 0.5 m and around w/2 here.

FIG. 3 is again used as the basis for the arrangement according to FIG. 6. Here an arrangement is provided in which just one additional electrode 107 is present per well pair. The electrode 107 here is positioned on the gap between two adjacent well pairs.

Specifically 1 again shows the oil reservoir, which is repeated a number of times on both sides of the sectional diagram. The horizontal pipe pair, i.e. the well pair, again consists of the injection pipe 101 and production pipe 102. The horizontal pipe 107 is also present, being configured as an electrode.

The selected diagram shows a repeating arrangement, in which a further electrode 107' is again present. Inductive energization is thus possible in so far as the ends of the two corresponding electrode pipes are connected electrically.

The arrangement according to FIG. 5 shows a reservoir width w of 100 m for example. There is a corresponding distance from one well pair to the next, it being possible reasonably to cover a region from 50 to 200 m. The reservoir height, i.e. the thickness of the geological oil stratum, is typically 20 to 60 m. The horizontal distance between the additional pipe and the well pair is identified by w/h. The vertical distance between the two additional electrodes is between 0.1 m and 0.9 h. Distances between 0.1 m and 60 m are exemplary here.

The electrodes have to be located at the lower end of the steam chamber to be established, i.e. at the lower end of the reservoir. The existing well pipes can preferably serve as electrodes there. Energization of the reservoir and thus heating should preferably take place inductively. Resistive heating of the reservoir is also possible but overheating of the electrodes must then be borne in mind.

The invention claimed is:

1. A method for the in situ extraction of bitumen or very heavy oil from oil sand seams close to the Earth's surface where thermal energy is introduced into the seam to reduce a viscosity of the bitumen or very heavy oil, the method comprising:

providing an extraction pipe to extract the liquefied bitumen or very heavy oil;

providing an injection pipe to introduce thermal energy;

introducing water into the seam;

heating the water; and evaporating the water in the seam using electrical heating, wherein the extraction pipe and the injection pipe are routed in a parallel manner, wherein water is used instead of steam as a thermal medium, wherein a conductor loop is used for inductive energization to evaporate the water introduced into the seam, wherein the method further comprises electrically connecting a first end of an electrode to a second end of the injection pipe for inductive heating purposes, wherein the injection pipe and the extraction pipe run horizontally one on top of the other in the seam and form a pipe pair, and wherein at least a first pipe pair and a second pipe pair are provided, the distance between the first and second pipe pairs being between 50 m and 200 m.

2. The method as claimed in claim 1, wherein the extraction pipe and injection pipe are also used as conductors.

3. The method as claimed in claim 1, wherein salts are added to the water to increase conductivity.

4. The method as claimed in claim 1, wherein a converter is used to provide electrical power in a form of a high-frequency current.

5. The method as claimed in claim 4, wherein the converter is connected to an electrical network of a power plant.

6. The method as claimed in claim 4, wherein the converter is connected to an electrical generator.

7. The method as claimed in claim 4, wherein a plurality of electrical conductors are energized by the converter and form the conductor loop in the seam.

8. The method as claimed in claim 7, wherein the plurality of electrical conductors are positioned on the pipe pairs.

9. An apparatus used for the in situ extraction of bitumen or very heavy oil from oil sand seams close to the ground surface, comprising:

an injection pipe for introducing thermal energy in the form of water into the seam; and an extraction pipe to extract the oil from the seam;

a converter; and a plurality of electrical conductors, wherein the injection pipe and the extraction pipe run horizontally one on top of the other in the seam and form a pipe pair, wherein the converter is connected to an electrical supply line and provides electrical power, wherein the plurality of electrical conductors are energized by the converter and form a conductor loop in the seam, wherein the conductor loop is configured to provide inductive energization to evaporate the water introduced into the seam, wherein a first end of an electrode is connected electrically to a second end of the injection pipe for inductive heating purposes, and wherein a distance from a first pipe pair to a second pipe pair is between 50 m and 200 m.

10. The apparatus as claimed in claim 9, wherein the converter is connected to an electrical network of a power plant.

11. The apparatus as claimed in claim 9, wherein the converter is connected to an electrical generator.

12. The apparatus as claimed in claim 9, wherein the plurality of electrical conductors are positioned on the pipe pairs.

13. The apparatus as claimed in claim 9, further comprising a plurality of separate electrodes for energization purposes, and wherein the plurality of electrodes are disposed at a predetermined distance from the pipe pairs.

14. The apparatus as claimed in claim 9, wherein a unit of the seam includes a cross-section defined by a width w and a height h, and wherein a horizontal distance of the plurality of electrodes from one of the pipe pairs is between 0.5 m and w/2.

15. The apparatus as claimed in claim 9, wherein a vertical distance from the electrode to the injection pipe is between 0.1 and 0.9 multiplied by a height h of the seam.

16. The apparatus as claimed in claim 9, wherein one electrode exists per pipe pair.

17. The apparatus as claimed in claim 16, wherein the one electrode is disposed on a gap between two adjacent pipe pairs.

* * * * *